United States Patent [19]

Smith et al.

[11] Patent Number: 4,607,849

[45] Date of Patent: Aug. 26, 1986

[54] JET EXHAUST SIMULATOR

[75] Inventors: David H. Smith, Fountain Valley; Roger D. Brum, Irvine, both of Calif.

[73] Assignee: Southwest Aerospace Corporation, Santa Ana, Calif.

[21] Appl. No.: 709,092

[22] Filed: Mar. 7, 1985

[51] Int. Cl.[4] ..... F41J 9/10

[52] U.S. Cl. ..... 273/348.1

[58] Field of Search ..... 273/348.1, 360, 361; 434/372, 389

[56] References Cited

U.S. PATENT DOCUMENTS 3,410,559 11/1968 Miller ..... 273/360

4,428,583 1/1984 Feagle ..... 273/348.1

*Primary Examiner*—Harland S. Skogquist

*Attorney, Agent, or Firm*—Stetina and Brunda

[57] ABSTRACT

A jet exhaust simulator provides a multichamber jet fuel burner in which the fuel supplies to the chambers may be remotely and independently controlled, and in which a pilot flame chamber with squib igniter provides a reliable source of combustion. Primary, secondary, and tertiary fuel nozzles are provided, with the tertiary nozzles using straight venturis to inject large fuel drops into a burning fuel/air mixture in order to produce an exhaust plume closely simulating the length and infrared light emissions characteristics of a jet aircraft engine. The exhaust simulator is particularly adapted for use in a towable aerial target for the testing of infrared seeker guided shells or missles.

13 Claims, 6 Drawing Figures

Fig. 1
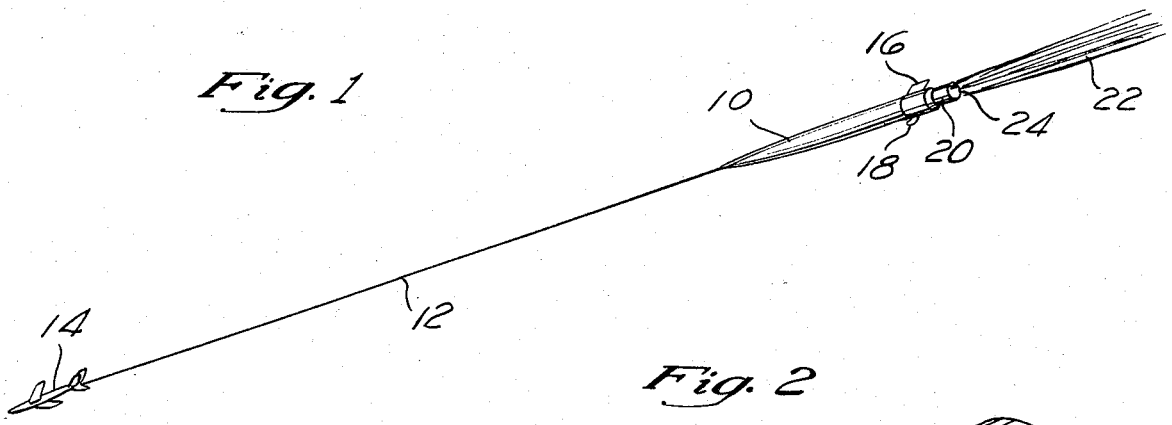
Fig. 2
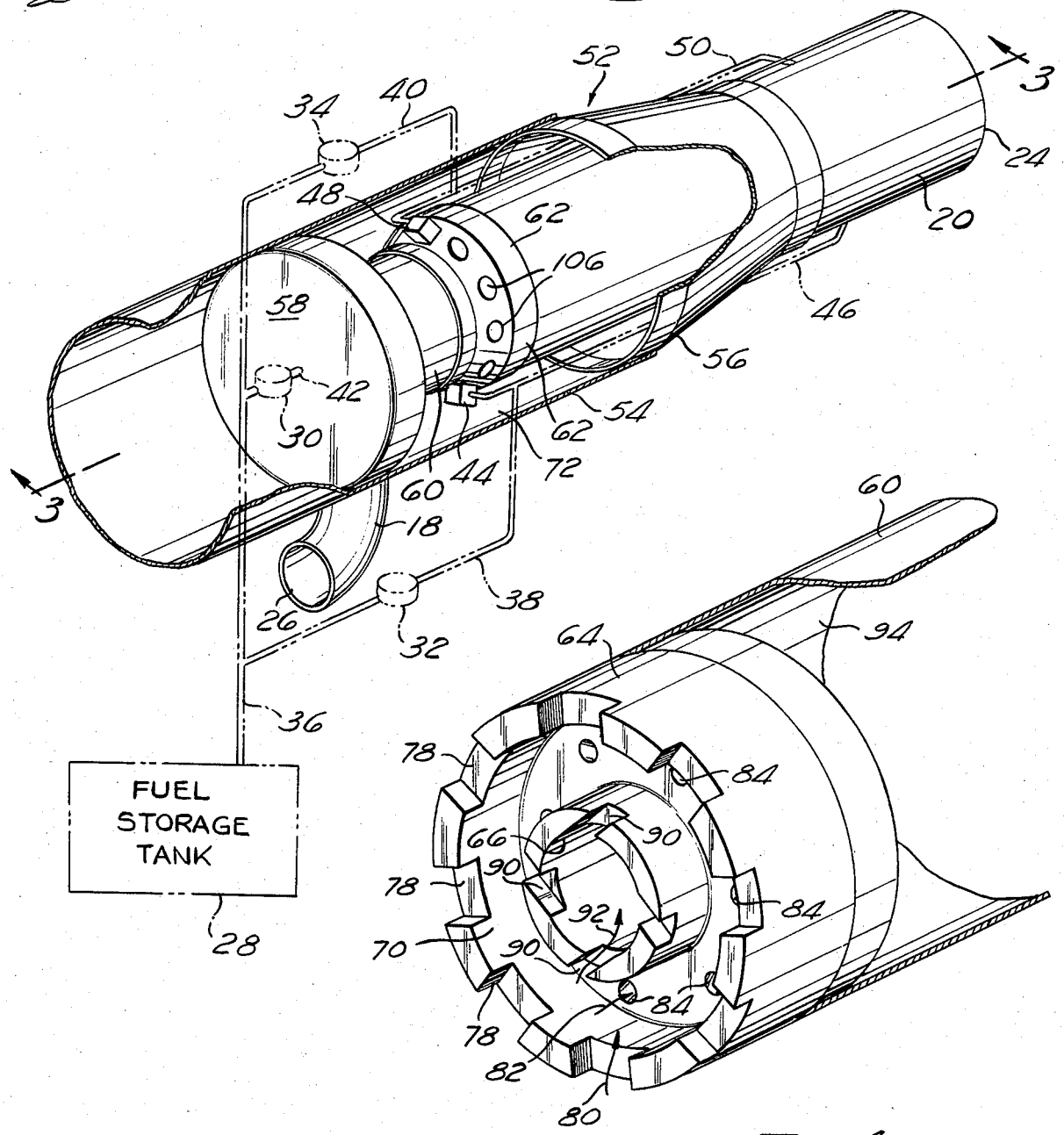
Fig. 4

JET EXHAUST SIMULATOR

BACKGROUND OF THE INVENTION

This invention relates generally to airborne targets used to simulate jet aircraft and particularly to airborne targets which produce an exhaust plume for use as a target for missiles and anit-aircraft shells having infrared detectors that respond to the infrared frequencies emitted by, and dimensions of the exhaust plume of a jet engine to follow or locate a target.

It is well known that aerial targets either towed by aircraft or mounted to the wing of the aircraft drones should simulate the characteristics of the aircraft against which anti-aircraft shells and missiles might be used. The exhaust plume is a distinctive characteristic of jet engines that infrared target seekers use to guide missiles toward an aircraft or to cause infrared-detecting shells to detonate. An effective target seeker must distinguish between actual jet aircraft engine plumes and decoy flares that are often released in attempts to divert warheads harmlessly away from an intended target. Note that decoy flares do not produce an exhaust plume having equivalent dimensions or equivalent infrared light emitting characteristics to those of jet aircraft engine. Therefore, a practice target should closely emulate the dimensions of, and spectral distribution of infrared light emitted by the exhaust plume of a jet engine to permit both testing and practice with anti-aircraft weapons.

Aerial targets for emulating jet engines ordinarily burn jet fuel, either JP4 or JP5, and include a combustor comprising one or more pyrotechnic igniters for igniting a fuel-air mixture. The purpose of the combustor is to simulate the jet exhaust by producing an exhaust plume closely matching the characteristics of a jet aircraft engine exhaust plume. The targets are controlled from a station on an aircraft or on the ground so that as the target comes within range of an anti-aircraft weapon, a nozzle in the combustor emits a fine spray of fuel, and an igniter is actuated to initiate combustion. An igniter generally is usable only once. A target may pass within range of a missile or gunnery station several times in a single flight of the towing aircraft.

Previous jet exhaust simulators require that at each pass, an additional igniter is expended to produce a plume for the target seeker and the plume is extinguished as the aerial target moves out of range in order to conserve fuel. When all of the igniters are expended, the targets become useless for infrared target seeker testing and practice since the plume may no longer be relit.

Previous jet exhaust simulators have additional disadvantages, including difficulties with igniting the fuel using igniters at high speeds and high altitudes. Such previous jet exhaust simulators also often fail to produce plumes that accurately represent the dimensions and infrared light spectral distributions of jet engine exhaust plumes.

Accordingly, there is a need for a target jet exhaust simulator that provides a plume at high speeds and high altitudes and which closely emulates that of jet aircraft engines and which does not require a plurality of pyrotechnic igniters whenever it is desired to actuate the target simulator several times during a single flight of the towing aircraft.

SUMMARY OF THE INVENTION

The present invention provides a jet exhaust simulator for use in an aerial target which overcomes the disadvantages of previous jet exhaust simulator systems. The present invention includes a combustor having a pilot flame chamber to which fuel is continuously supplied after ignition by a single igniter. When the jet exhaust simulator according to the invention is actuated to produce a plume to simulate a jet engine, fuel is injected into a secondary flame chamber and ignited by the flame that continuously burns in the pilot flame chamber. The burning fuel air mixture then passes into a burn tube which receives additional fuel from a tertiary fuel injection system. The burning fuel mixture is then expelled from the burn tube to produce the desired plume. As such, the present invention provides a staged combustion of the fuel/air mixture which builds up to high heat levels necessary for reliable operation at high altitude and high air speed conditions.

BRIEF DESCRIPTION OF THE DRAWINGS

FIG. 1 is a side perspective view of an airplane towing an aerial target which includes the jet exhaust simulator of this invention.

FIG. 2 is a partially cut away side perspective view of the jet exhaust simulator of FIG. 1 and showing, in phantom, the connection of fuel valves and a fuel storage tank to the target augmentor.

FIG. 4 is a rear perspective view of the pilot flame chamber burner head of the combustor of FIG. 2.

DESCRIPTION OF THE PREFERRED EMBODIMENT

Figure 3:
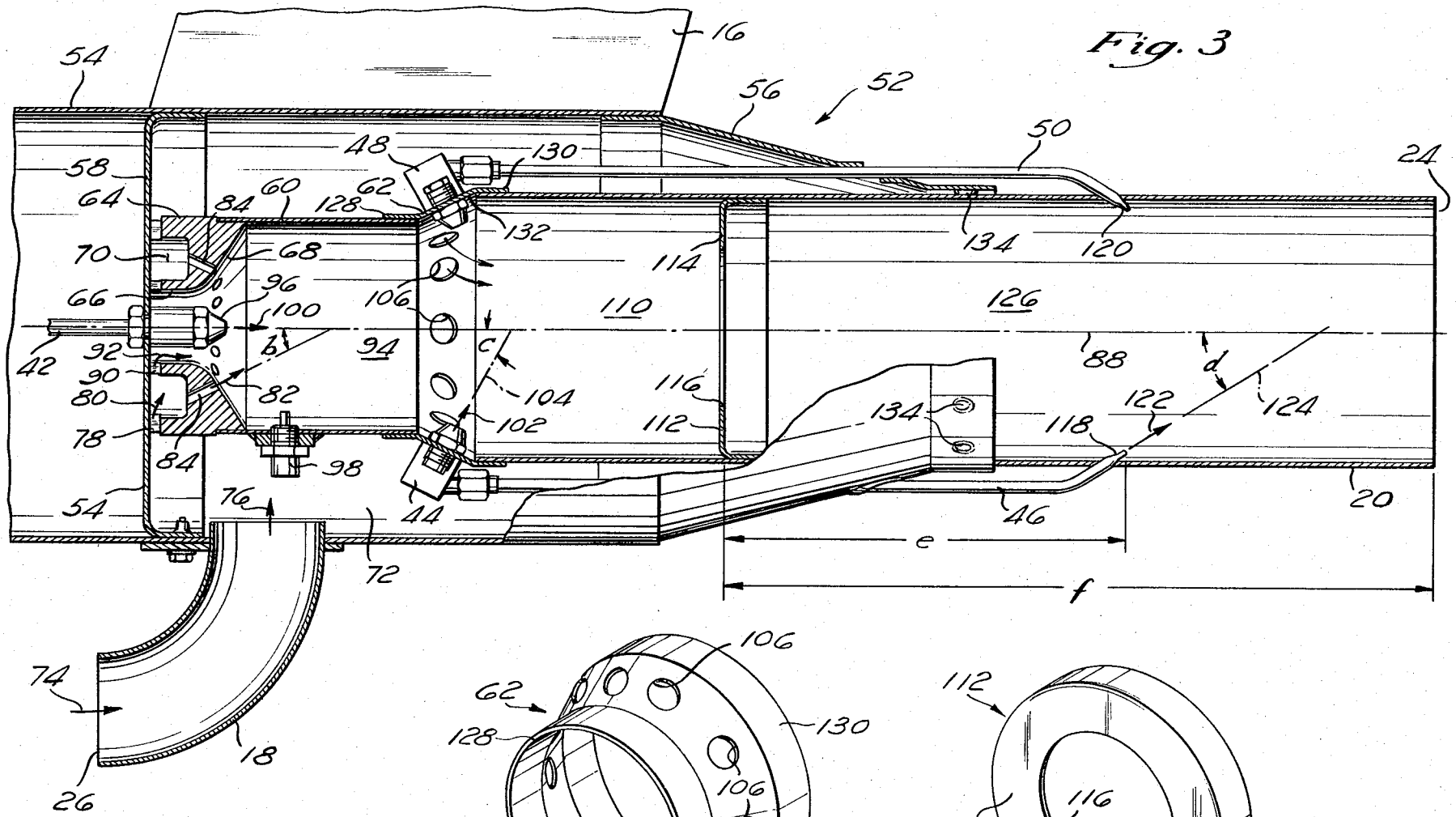
FIG. 3 is a partially cut-away side view of the combustor taken generally in the direction of the arrows 3—3 of FIG. 2.

Referring first to FIG. 1, the aerial target 10 is shown in use as it is pulled through the air by a tow cable 12 connected to an airplane 14. The aerial target 10 has stablizing fins 16, an air collection scoop 18, and a burn tube 20. The aerial target 10 produces an exhaust plume 22 which extends for a distance from the tube exit end 24. The function of the aerial target 10 is to simulate the jet exhaust produced by a jet airplane engine. The aerial target 10 produces an exhaust plume 22 which has a length very similar to the length of a jet airplane exhaust plume. Also, the exhaust plume 22 emits infrared light having a similar spectrum of frequency bands with a similar intensity distribution to that of the infrared light emitted by jet airplane exhaust plume. The aerial target 10 may be used for target practice in the testing of heat seeking anti-aircraft missiles and projectiles. The function of the tow cable 12 is to pull the aerial target 10 through the air at a large distance behind the airplane 14; however, the target 10 can additionally be mounted directly to the wing of a drone aircraft in desired applications to augment otherwise insufficient exhaust plumes.

Referring next to FIG. 2, the air collection scoop 18 of the aerial target 10 has a scoop entrance end 26 which collects air as the aerial target 10 is towed by the airplane 14. The scoop entrance end 26 is preferably circular, with a diameter of approximately 1.875 inches. Air is forced into the entrance end 26 by impact pressure as the target 10 is towed. The fuel storage tank 28, fuel valves 30, 32, and 34, and fuel lines 36, 38, and 40 are shown in phantom in FIG. 2 and are preferably located inside the aerial target 10, but are drawn as shown in FIG. 2 for purposes of clarity in the illustration. However, it is recognized that the fuel may be supplied from other sources such as directly from the dromed aircraft in the event that the jet exhaust simulator is mounted to it. The fuel storage tank 28 may be used to contain standard liquid jet engine fuel, such as types JP4 and JP5. Engine fuel is provided from the storage tank 28 to the fuel valves 30, 32, and 34 through the fuel line 36. The fuel storage tank 28 is typically pressurized by a pnuematic tank (not shown), and supplies fuel through the fuel line 36. The fuel valves 30, 32, and 34 may be selectively, and independently, actuated to control the flow of fuel from the fuel line 36 into the fuel lines 42, 38, and 40, respectively. The valves 30, 32, and 34 are preferably electrically actuated solenoid valves remotely controlled by conventional circuitry (not shown) which responds to electrical signals received from the airplane 14 through the tow cable 13 or, alternatively, to radio signals received from the airplane 14 or from the ground. The valves 32 and 34 may be actuated separately from the valve 30 so that a pilot flame may be maintained burning inside the pilot tube 60 when the plume 22 is extinguished to preserve fuel.

The fuel line 38 is connected to supply fuel to the secondary nozzle 44 and the tertiary injector line 46. The fuel line 40 is connected to supply fuel to the secondary nozzle 48 and tertiary injector line 50.

A jet exhaust simulator 52 is mounted inside the target body 54 and support ring 56 of the aerial target 10 in order to simulate a jet engine exhaust. The exhaust simulator 52 includes the air collection scoop 18, a pilot flame chamber support 58, a pilot tube 60, and an expander ring 62 attached to the tube 60. The burn tube 20 is attached to the expander ring 62, and interior structures not shown in FIG. 2. The expander ring 62 may be formed as a separate portion of burn tube 20 (as shown) or, alternatively, may be formed integrally with the burn tube 20.

As best shown in FIGS. 3 and 4, the pilot flame chamber head 64 is preferably composed of aluminum and is securely attached to the pilot flame chamber 58. The function of the pilot chamber head 64 is to support the pilot tube 60 and to control the flow of air into the pilot tube 60. The pilot chamber head 64 is shaped as a circular disk having a central bore 66 with a funneled opening 68 which opens away from the pilot chamber support 58. The pilot chamber head 64 is equipped with a recessed annular air chamber 70 surrounding the central bore 66.

An air chamber 72 is formed inside the aerial target 10 around the pilot tube 60 and is defined by the space bounded by the target body 54, support ring 56, burn tube 20, expander ring 62, pilot tube 60, pilot chamber head 64, and pilot chamber support 58. The air chamber 72 is connected to receive the air collected by the scoop 18. Air flows into the scoop 18 in the direction shown by the arrow 74 as the aerial target 10 is towed through the air. Air flows from the scoop 18 into the air chamber 72 in a direction shown by arrow 76. Air flows from the air chamber 72, through the inlet port 78 in the pilot chamber head 64 in the direction shown by the arrow 80 and subsequently into the annular air chamber 70. Inlet port 78 is typically formed of eight such similar inlet ports equally spaced around the circumference of the pilot chamber head 64, with each of the inlet ports allowing air flow in a direction corresponding to the arrow 80 into the annular air chamber 70. However, it will be recognized that other inlet port configurations such as a single aperture and metering orifice can be used for the inlet port 78. Air flows out from the annular air chamber 70 in the direction of the arrow 82 through a metering orifice 84 which extends through the pilot chamber head 64, between the inside of annular air chamber 70 and the funneled opening 68. The metering orifice 84 is typically formed of twelve such similar orifices which are evenly spaced in a circular pattern around the central bore 66. The orifices 84 are preferably a 0.25 inch diameter bore having a center line 86 which either makes an angle b with the center line 88 of the pilot chamber head 64 or are coaxial therewith. It is preferable that the angle b is an angle between approximately zero degrees and thirty degrees with half of the orifices being angularly oriented and the remaining half being co-axial.

Air flows from the annular air chamber 70 through the tangential air injection port 90 into the bore 66 in the direction shown by arrow 92. The tangential air injection port 90 is typically formed of four to six similar tangential air injection ports in the pilot chamber head 64 and arranged around the central bore 66. The air flow shown by arrows 82 and 92 flows into the pilot flame chamber 94 thereby creating a swirling air flow inside the pilot tube 60. The pilot flame chamber 94 has a circular, cylindrical or slightly conical shape with an axis along the centerline 88.

A pilot nozzle 96 is securely mounted to the pilot chamber support 58 and is positioned inside the central bore 66 of the pilot chamber head 64. The pilot nozzle 96 preferably has its center line aligned with the pilot chamber head center line 88. The pilot nozzle 96 is connected to the fuel line 42 in order to provide jet engine fuel in the direction of the arrow 100 along the center line 88 inside the pilot flame chamber 94. It is preferable that jet engine fuel be provided through the pilot nozzle 96 at a rate of approximately 1.0 to 2.5 gallons per hour. Fuel squirts from the nozzle 96 in an atomizing spray of small fuel droplets which mix with the air flowing from the metering orifices (such as orifice 84) and from the tangential air injection ports (such as port 90) in order to produce a combustible fuel/air mixture inside the pilot flame chamber 94. The pilot nozzle 96 is provided with a fuel pressure of between approximately fifty and one hundred and ten pounds per square inch through the fuel line 42.

The pilot tube 60 is preferably formed as a circular sheet metal tube having a diameter of approximately 4.0 inches plus or minus 1.00 inches.

An igniter 98 is mounted in the side wall of the pilot tube 60. The function of the igniter 98 is to ignite the jet engine fuel and air mixture present inside the pilot flame chamber 94 in order to light a pilot flame from the nozzle 96. The igniter 98 is preferably a pyrotechnic squib incendiary device which is remotely controlled by circuitry (not shown) which responds to electrical signals received from the airplane 14 through the tow cable 12 or, alternatively, to radio signals received from the airplane 14 of from the ground. The igniter 98 is actuated once during use of the aerial target 10 in order to light the pilot flame which then becomes continuously self-sustaining inside the pilot flame chamber 94. The air flow from the tangential air injection ports swirls around the pilot nozzle 96 and combines with the air flow from the metering orifices to provide combustion air to the pilot flame, to allow the pilot flame to be readily lit by the igniter 98, and to maintain the pilot flame reliably lit as the target 10 is towed.

The expander ring 62 is securely attached to the pilot tube 60 at its end opposite the pilot chamber head 64. The expander ring 62 securely attaches the pilot tube 60 to the entrance end of the burn tube 20. The burn tube 20 is preferably formed as a cylindrical metal tube having a diameter of approximately 5.0 inches plus or minus 0.25 inches. The expander ring 62 provides a transition between the differing diameters of the pilot tube 60 and the burn tube 20. The secondary nozzles 44 and 48 are securely attached to and project through the expander ring 62. Jet engine fuel flows out from the nozzle 44 in the direction of the arrow 102 along the center line 104 of the secondary nozzle 44. The center line 104 intersects the center line 88 at an angle c which is preferably approximately sixty degrees plus or minus fifteen degrees. The secondary nozzle 48 has its center line (not shown) similarly oriented with respect to the center line 88.

A secondary air injection port 106 is preferably formed as a circular aperture in the side wall of expander ring 62 to allow the flow of air from the air chamber 72, through the port 106, and into the secondary flame chamber 110. Typically eight to ten such secondary air injection ports 106 are formed as one-half inch diameter apertures evenly spaced around the circumference of the expander ring 62. Alternatively, the air injection port 106 may be formed as a one quarter inch diameter aperture, in which case thirty-two such air injection ports would be spaced around the circumference of expander ring 62. The secondary air injection ports provide combustion air for the burning of fuel passing through the secondary nozzles 44 and 48 and tertiary nozzles 118 and 120. The secondary air injection ports are positioned on the expander ring 62 and directed at the same angle c as the nozzles 44 and 48 in order to direct the air flow away from the pilot flame chamber 94 in order to avoid interference with the pilot flame in chamber 94.

The secondary flame chamber 110 is the area inside the walls of the burn tube 20 between the expander ring 62 and a flame holder ring 112. The flame holder ring 112 preferably has a washer shaped orifice plate 114 with a central orifice 116. The central orifice 116 is preferably a circular aperture having a diameter of approximately three inches. The flame holder ring 112 is preferably a one piece sheet metal ring securely attached inside the burn tube 20.

Jet engine fuel is provided by the fuel line 38 to the secondary nozzle 44 at a pressure between fifty and one hundred and ten pounds per square inch in order to produce a fuel flow rate of between approximately three and ten gallons per hour through the secondary nozzle 44 in the direction of the arrow 102, in order to spray a fine mist of fuel droplets inside the secondary flame chamber 110. A similar fine spray of fuel droplets is produced by the secondary nozzle 48.

For clarity of the illustration, the fuel lines 38 and 40 shown in FIG. 2 have been omitted from the drawing of FIG. 3.

Tertiary nozzles 118 and 120 are securely mounted in the sidewalls of burn tube 20 and are connected to teritary injector lines 46 and 50, respectively. Tertiary nozzles 118 and 120 are preferably straight venturi nozzles. Tertiary nozzle 118 preferably has an orifice size of between 0.020 and 0.040 inches in diameter. However, they may alternately be of the atomizing spray type. Tertiary nozzle 120 has a construction similar to nozzle 118. Tertiary nozzle 118 is provided with fuel by the injector line 46 at a pressure of between fifty and one hundred and ten pounds per square inch in order to produce fuel flow in the direction of the arrow 122 at a rate of between approximately six and eighteen gallons per hour in a non-atomizing spray to produce relatively large drops so that the desired large length of the plume 22 (see FIG. 1) is produced.

The tertiary nozzle 118 produces a squirt of fuel flow comprising large fuel droplets in the direction of arrow 122 along the nozzle center line 124 which intersects the center line 88 at an angle d. The angle d is preferably between approximately 10 and 30 degrees. The tertiary nozzle 120 produces a similar fuel flow in a corresponding direction.

In FIG. 3, the distance e is the distance between the flame holder ring 112 and the tertiary nozzles 118 and 120 as shown. The distance f is the distance between the flame holder ring 112 and the exit end 24 of the burn tube 20. The distance e is preferably approximately 6.75 inches plus or minus one inch, and the distance f is preferably approximately 12.5 inches plus or minus 3.0 inches.

Mixing chamber 126 is inside the burn tube 20 and is located between the flame holder ring 112 and the exit end 26 of burn tube 20. The constriction provided by orifice plate 114 of the flame holder ring 112 creates turbulence along the inside wall, over the distance e of burn tube 20 in the mixing chamber 126. Such turbulence serves to uniformly distribute fuel droplets and combustion gasses received from the pilot nozzle 96 and secondary nozzles 44 and 48 over the volume inside the mixing chamber 26 between the flame holder ring 112 and the tertiary nozzles 118 and 120.

The burn tube 20 is stabilized in place by a sliding slip fit inside the support ring 56. The support ring 56 has a plurality of inwardly projecting dimples, typified by dimple 134, which make frictional contact with the outer periphery of burn tube 20. Such dimples allow for a radial separation gap of approximately 0.035 inches between the dimension changes due to thermal expansion as well as provides for limited axial thermal expansion of the burn tube 20.

Mixing and ignition of large fuel drops from the tertiary nozzles 118 and 120 occurs inside the mixing chamber 126 as the burning fuel/air mixture passes through the burn tube 20 and out the tube exit end 24. The mixture of air with fuel from the secondary nozzles 44 and 48 and the tertiary nozzles 118 and 120 in a burning flow through the burn tube 20 produces the plume 22 with the desired length a and with the desired infrared light emission characteristics.

Referring next to FIG. 4, the pilot chamber head 64 has a solid cylindrical shape with an annular groove in the base thereof to form the annular air chamber 70. The inlet port 78 is formed as a radial slot in the outer periphery of the base of the head 64 to allow airflow in the direction of the arrow 80 into the chamber 70. The tangential air injection port 90 is formed as a tangential slot in the inner periphery of the base of the head 64 to allow airflow in the direction of the arrow 92 into the central bore 66 from the chamber 70. The tangential direction of the slot forming the port 90 causes the airflow along arrow 92 to be a helical swirling flow inside the bore 66 and flowing into the pilot flame chamber 94.

Figure 5:
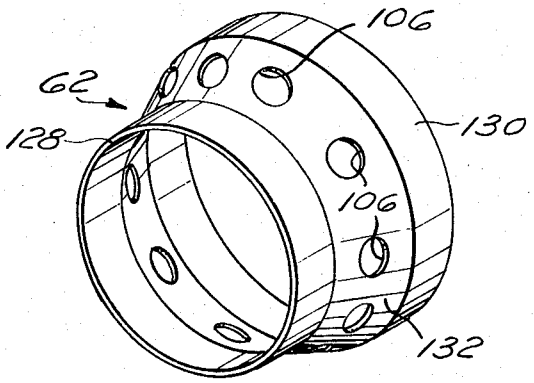
FIG. 5 is a rear perspective view of the expansion ring used in the combustor of FIG. 2.

Referring next to FIG. 5, the expander ring 62 is preferably formed of sheet metal and has a ring 128 having a diameter of size to force fit over the pilot tube 60 (see FIG. 3), and has a burn ring 130 of size to force fit over the burn tube 20. A tapered section 132 forms a side wall extending between the rings 128 and 130. The tapered section 132 has ten to twelve circular apertures therethrough, two of which provide mounting for secondary nozzles 44 and 48, and the remaining of which serve as secondary air injection ports (such as secondary air injection port 106). The shape of the tapered section 132 determines the size of the angle c (see FIG. 3) by directing the nozzles 44 and 48 to the desired degree of tilt. That is, a steep taper for section 132 produces a smaller angle c than a gradual taper for section 132.

Figure 6:
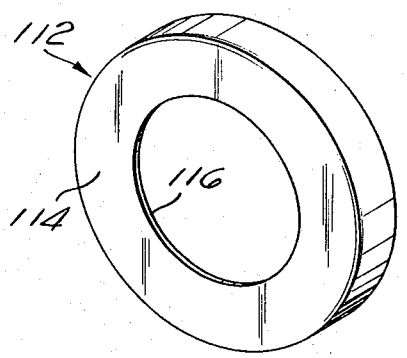
FIG. 6 is a rear perspective view of the flame holder ring used in the combustor of FIG. 2.

Referring next to FIG. 6, the flame holder ring 112 is preferably formed of sheet metal and has the orifice plate 114 shaped to tightly fit inside the burn tube 20.

DESCRIPTION OF THE PREFERRED EMBODIMENT OPERATION

The aerial target 10 is initially prepared for flight by filling the fuel storage tank 28 with liquid fuel, mounting an unused squib as the ignitor 98, pressurizing the pnuematic tank, and keeping the valves 30, 32, and 34 closed. The aerial target 10 is attached to the airplane 14 which then takes off and begins flying. The aerial target 10 is then released from the airplane 14 and is towed by the cable 12 as shown in FIG. 1. The valve 30 is opened by remote control to allow fuel to be pumped through the pilot nozzle 96. Note that as the aerial target 10 is towed, air flows into the air collection scoop 10 and is forced by impact pressure through the pilot chamber head 64. After fuel flow has been initiated through the pilot nozzle 96, the igniter 98 is actuated by remote control to ignite the combustible fuel/air mixture inside the pilot flame chamber 94 to light a pilot flame which consumes a relatively small amount of fuel flow, approximately 1.0 to 2.5 gallons per hour. Only a very small exhaust plume is produced when only the pilot flame is lit.

The airplane then flies on a path suitable for the target practice to be performed. When the aerial target 10 reaches the location desired for the start of the target practice, the valves 32 and 34 are opened by remote control to allow fuel flow through the secondary nozzles 44 and 48 and the tertiary nozzles 118 and 120 so that a relatively large amount of fuel flow, between approximatley 15.0 and 58.5 gallons per hour, flows through the burn tube 20 and is burned to produce the exhaust plume 22 having the desired length a and the desired infrared light emitting characteristics. Target practice may then commence with the aerial target 10 acting as a high quality jet exhaust simulator. When the aerial target 10 has been towed out of range for target practice, the fuel valves 32 and 34 may be closed by remote control to extinguish the desired exhaust plume 22 and conserve fuel, while maintaining the fuel valve 30 open to supply the low fuel consumption pilot flame through the pilot nozzle 96 inside the pilot flame chamber 94. Therefore, the pilot flame inside the chamber 94 remains lit and the aerial target is in a standby status when the plume 22 is extinguished by closing the valves 32 and 34. This standby status allows for fuel conservation while the aerial target 10 is towed back into target practice range or is moved to different elevations.

When the aerial target 10 is back in a desired position to restart the target practice, the fuel valves 32 and 34 are opened again by remote control to again produce the desired exhaust plume 22 to act as a high quality jet exhaust simulator. Note that the pilot flame inside the chamber 94 need be lit only once during a flying session and that the desired exhaust plume 22 may be initiated and extinguished in a plurality of cycles.

The aerial target 10 described herein has a particular advantage in that only one squib igniter 98 is required for a target practice flight. Also, the igniter 98 may be actuated when the aerial target 10 is moving at a low altitude and slow speed in order to easily and reliably (with near 100% reliability) light a pilot flame inside the pilot flame chamber 96. The aerial target 10 may then be accelerated and moved to higher altitudes while conserving fuel, and the exhaust plume 22 may be easily and reliably (with near 100% reliability) lit using the pilot flame. In this regard, the present invention provides a staged combustion effect wherein additional air and fuel are provided at axial locations along the length of the device to gradually build up sufficient heat to provide an exhaust plume at high altitude (approximately 20,000 feet) and high air spped applications.

It is possible that variations or modifications may be made in the preferred embodiment of the invention described herein in order to form equivalent constructions or operations, without departing from the spirit of the invention having the scope defined by the following claims.

What is claimed is:

1. A jet exhaust simulator for producing an exhaust plume from a aerial target using fuel supplied from an internal fuel storge tank or host aircraft tank source, said exhaust simulator comprising:

an air collection scoop for collecting air a pilot chamber head and a pilot flame chamber having a generally cylindrical shape, said pilot chamber head having the shape of a circular disk with an axis and having a central bore along said axis and with a funneled opening into said pilot flame chamber, said pilot chamber head also having an annular air chamber around said central bore and connected to receive air collected by said air collection scoop, said pilot chamber head further having a plurality of metering orifices between said annular air chamber and said funneled opening for directing air from said annular air chamber into said pilot flame chamber, said pilot chamber head further having a plurality of tangential air injection ports between said annular air chamber and said central bore for directing a swirling flow of air from said annular air chamber, through said central bore and into said pilot flame chamber;

a pilot nozzle connected to receive fuel from said fuel source, and mounted inside said central bore along the axis thereof to squirt fuel into said pilot flame chamber and inside the flow of air from said metering orifices and said tangential air injection ports, and to produce a stable pilot flame inside said pilot flame chamber;

an igniter mounted in said pilot chamber for igniting the fuel flowing from said pilot nozzle to light said pilot flame;

a burn tube having an axis aligned with said axis of said pilot chamber head, connected to receive gases flowing from said pilot flame chamber, said burn tube having a flame holder ring mounted inside thereof for defining a secondary flame chamber between said pilot flame chamber and said flame holder ring and a mixing area between said orifice plate and an exit end of said burn tube, said burn tube having a plurality of secondary air injection ports connected to transfer air from said air collection scoop into said secondary flame chamber near said entrncee end of said burn tube;

a plurality of secondary nozzles connected to receive fuel from said fuel source, and mounted to squirt fuel to mix with the flow of air from said secondary air injection ports, and to produce a secondary flame inside said secondary flame chamber and ignited by said pilot flame; and a plurality of tertiary nozzles connected to receive fuel from said fuel source, and mounted to squirt fuel inside said mixing chamber intermediate the length thereof and to combine with gases from said secondary flame area and become ignited thereby to produce said exhaust plume at said exit end of said burn tube.

2. The jet exhaust simulator of claim 1 wherein said plurality of metering orifices are evenly spaced in a circular pattern around said central bore and are directed at an angle of between approximately zero degrees and thirty degrees from said pilot chamber head axis.

3. The jet exhaust simulator of claim 1 wherein said secondary nozzles are directed at an angle of approximately sixty degrees plus or minus approximately fifteen degrees from said axis of said burn tube.

4. The jet exhaust simulator of claim 1 wherein said tertiary nozzles are directed at an angle of between approximately ten degrees and forty degrees from said axis of said burn tube.

5. The jet exhaust simulator of claim 1 wherein said pilot nozzle produces an atomizing spray of small fuel droplets with a fuel flow rate of approximately 1.0–2.5 gallons per hour.

6. The jet exhaust simulator of claim 1 wherein each of said secondary nozzles produce an atomizing spray of small fuel droplets with a fuel flow rate of between approximately 3 and 10 gallons per hour.

7. The jet exhuast simulator of claim 1 wherein each of said tertiary nozzles comprise straight venturi nozzles to produce a non-atomizing spray of large fuel drops with a fuel flow rate of between approximately 6 and 30 gallons per hour.

8. The jet exhaust simulator of claim 1 further comprising:

a first fuel flow control means which is remotely actuatable for controlling the flow of fuel from said fuel source to said pilot nozzle; and a second fuel flow control means which is remotely actuatable, and which may be actuated separately from actuation of said first fuel flow control means, and for controlling the flow of fuel from said fuel source to said secondary and tertiary nozzles.

9. A jet exhaust simulator capable of being reliably ignited at high altitudes and high air speeds comprising:

a housing adapted to be affixed to an aircraft defining a pilot chamber and a secondary chamber;

means for supplying fuel into said pilot and secondary chambers;

inlet means for directing air into said pilot and secondary chambers;

valve means for continuously supplying fuel to said pilot chamber and selectively supplying fuel to said secondary chamber; and igniter means positioned within said pilot chamber for igniting the fuel/air mixture within said pilot chamber, said pilot chamber positioned proximal said secondary chamber to ignite the fuel/air mixture within said secondary chamber when the fuel is selectively supplied to said secondary chamber.

10. The jet exhaust simulator of claim 9 wherein said fuel supplying means comprises a first nozzle positioned within said pilot chamber and a second and third nozzle positioned within said secondary chamber, said second and third nozzles being axially spaced from one another along the length of said secondary chamber to provide a staged combustion of the fuel/air mixture contained within said secondary chamber.

11. The jet exhaust simulator of claim 10 further comprising means for varying the amount of fuel supplied to said first, second and third nozzle means.

12. The jet exhaust simulator of claim 11 further comprising means for varying the amount of air directed into said pilot and secondary chambers.

13. The jet exhaust simulator of claim 12 wherein said pilot and secondary chambers are co-axially positioned within said housing.

* * * * *